US006179726B1

(12) United States Patent
Satoh et al.

(10) Patent No.: US 6,179,726 B1
(45) Date of Patent: Jan. 30, 2001

(54) IRON GOLF CLUB SET

(75) Inventors: Tokuo Satoh, Fuchu; Hiroshi Ishikawa, Tokyo-to, both of (JP)

(73) Assignee: Ryobi Limited, Fuchu (JP)

( * ) Notice: Under 35 U.S.C. 154(b), the term of this patent shall be extended for 0 days.

(21) Appl. No.: 09/378,996

(22) Filed: Aug. 23, 1999

(30) Foreign Application Priority Data

Sep. 25, 1998 (JP) ..... 10-272150

(51) Int. Cl.[7] ..... A63B 53/04
(52) U.S. Cl. ..... 473/290; 473/346; 473/350
(58) Field of Search ..... 473/290, 291, 473/346, 350

(56) References Cited

U.S. PATENT DOCUMENTS 5,209,473 * 5/1993 Fisher .
5,423,546 * 6/1995 Manning .
5,429,353 * 7/1995 Hoeflich .
5,547,426 * 8/1996 Wood ..... 473/290
5,665,009 * 9/1997 Sherwood ..... 473/291

* cited by examiner

*Primary Examiner*—Jeanette Chapman
*Assistant Examiner*—Stephen L. Blau
(74) *Attorney, Agent, or Firm*—Oliff & Berridge, PLC

(57) ABSTRACT

An iron golf club set comprises a plurality of iron golf clubs having respective club numbers different from each other. Sole widths of the iron golf clubs become gradually larger from No. 7 iron club toward a lower lofted iron club having the smaller loft angle than that of the No. 7 iron club and a higher lofted iron club having the larger loft angle than that of the No. 7 iron club. The sole widths of No. 5 iron club and iron golf clubs having the smaller loft angle than that of the No. 5 iron club are larger than the sole width of a sand wedge.

6 Claims, 8 Drawing Sheets

IRON GOLF CLUB SET

BACKGROUND OF THE INVENTION

1. Field of the Invention

The present invention relates to an iron golf club set.

2. Description of the Related Art

In general, an iron golf club set is composed of a plurality of iron golf clubs having respective club numbers different from each other. The iron golf club set is composed for example of 10 clubs, i.e., seven iron clubs of No. 3 to No. 9 and three wedge clubs of a pitching wedge, an approach wedge and a sand wedge.

The sole width of each of these iron golf clubs has a great influence on a position of center of gravity of the iron golf club.

Description will be given below of sole widths of the numbered clubs of the conventional iron golf club set with reference to FIG. 14. FIG. 14 is a graph illustrating a relationship between the numbered clubs of the conventional iron golf club set with their sole widths. An abscissa of the graph represents a number of the club and an ordinate represents a sole width. In FIG. 14, "X" indicates a straight solid line connecting values of sole width of the respective numbered clubs of the conventional iron golf club set (hereinafter referred to as the "prior art 1"), "Y" indicates a straight dotted line connecting values of sole width of the respective numbered clubs of another conventional iron golf club set (hereinafter referred to as the "prior art 2"), and "Z" indicates straight one-point chain lines connecting values of sole width of the respective numbered clubs of further another conventional iron golf club set (hereinafter referred to as the "prior art 3").

As is clear from FIG. 14, in the prior art 1, the sole widths of the iron golf clubs gradually increase from No. 3 iron club toward a sand wedge. On the contrary, in the prior art 2, the sole widths of the iron golf clubs gradually decrease from No. 3 iron club toward the sand wedge. In the prior art 3, the sole widths of the iron golf clubs gradually decrease from No. 3 iron club toward No. 5 iron club, while the sole widths thereof gradually increase from No. 5 iron club toward the sand wedge.

However, in the prior art 1, it is hard for a golf player to hit a golf ball with the use of the lower lofted irons, especially the so-called long iron clubs of No. 3 to No. 5 irons, thus requiring a skilful technique for using such lower lofted irons efficiently. Such a tendency will be described with reference to FIG. 15. The lower lofted iron club of the iron golf club set of the prior art 1 has a narrow sole width W2. Accordingly, the center of gravity G2 of the head H has a tendency to be apart upward from the sole 8 by the long distance H2 and to come close to the face 7, resulting in a smaller value of depth of the center of gravity, i.e., the shorter horizontal distance D2 from the leading edge 11 to the center of gravity G2. The sweet spot of the iron golf club therefore becomes narrower, leading to difficulty to hit, and making it hard to increase the trajectory of the resultant ball flight after being hit by the club. In FIG. 15, "S" is a shaft, "9" is a hosel and "10" is a back face.

On the contrary to the prior art 1, in the prior art 2, it is hard for a golf player to hit a golf ball with the use of the higher lofted irons, especially the so-called short iron clubs of from No. 9 iron to the sand wedge, thus requiring a skilful technique for using such higher lofted irons efficiently.

In the prior art 3, although the lower lofted iron club has a relatively long sole width, thus improving in hitting properties, the sole width of the lower lofted iron club is, at the most, substantially identical with the sole width of the sand wedge, thus making it still hard for an average recreational golf player to use such a club efficiently.

SUMMARY OF THE INVENTION

An object of the present invention is therefore to provide an iron golf club set, which permits to lower the center of gravity of a club head to ensure a wide sweet spot, thus improving in hitting properties, and makes it possible to easily increase the trajectory of the resultant ball flight after being hit with the use of any one of numbered clubs, especially a lower lofted iron club.

In order to attain the aforementioned object, an iron golf club set of the present invention comprises:

a plurality of iron golf clubs having respective club numbers different from each other, wherein:

sole widths of said iron golf clubs become gradually larger from No. 7 iron club toward a lower lofted iron club having a smaller loft angle than that of said No. 7 iron club and toward a higher lofted iron club having a larger loft angle than that of said No. 7 iron club; and the sole widths of No. 5 iron club and iron golf clubs having a smaller loft angle than that of said No. 5 iron club are larger than a sole width of a sand wedge.

Shafts for the No. 7 iron club and iron golf clubs having a larger loft angle than that of the No. 7 iron club may have a larger tip diameter than that of shafts for No. 6 iron club and iron golf clubs having a smaller loft angle than that of the No. 6 iron club.

A face of each of the iron golf clubs may have on its back surface ribs projecting rearward; and the ribs may have projection lengths, which vary in a vertical direction and/or a horizontal direction of the face.

The ribs may form a honeycomb structure.

DETAILED DESCRIPTION OF THE PREFERRED EMBODIMENTS

Now, an iron golf club set of the first embodiment of the present invention will be described in detail below with reference to FIGS. 1 to 3.

The iron golf club set of the present invention is composed of 10 clubs, i.e., seven iron clubs of No. 3 to No. 9 and three wedge clubs of a pitching wedge, an approach wedge and a sand wedge.

Figure 1:
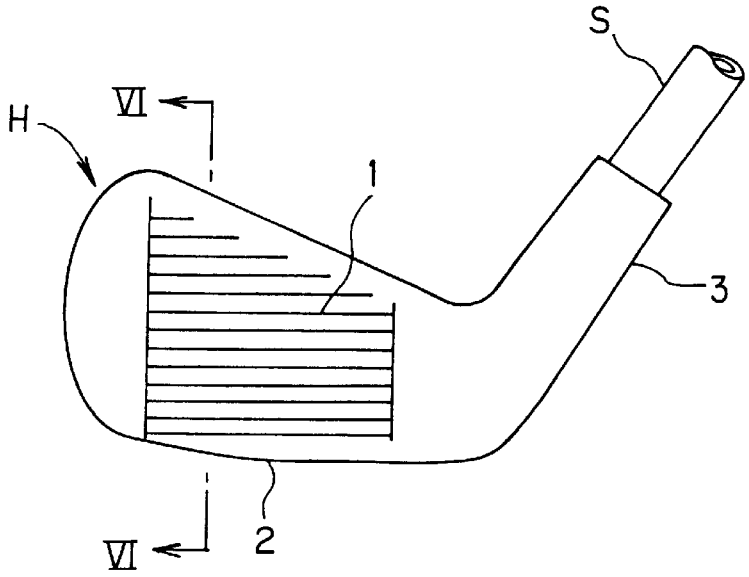
FIG. 1 is a partial front view illustrating one of a plurality of iron golf clubs forming an iron golf club set of the present invention.
Figure 2:
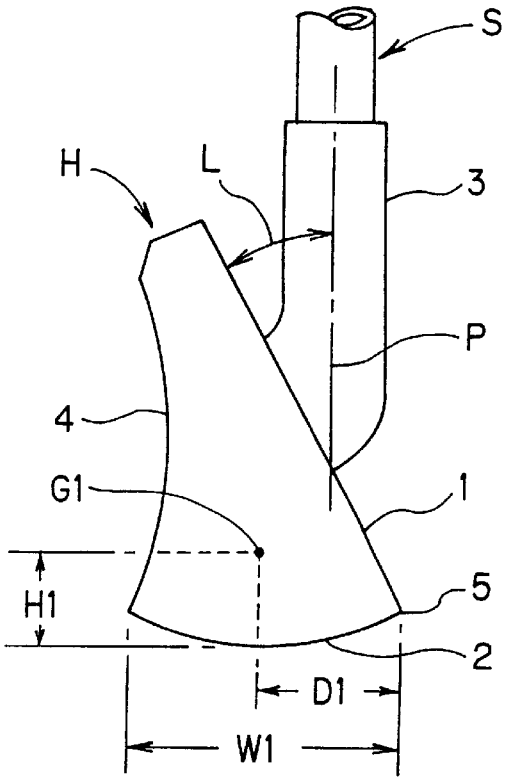
FIG. 2 is a side view of the iron golf club as shown in FIG. 1.

Each of these clubs is composed of a shaft S, a head H fixed to the front end of the shaft S and a grip (not shown) fixed to the rear end of the shaft S as shown in FIG. 1. The head H is provided with a face 1, a sole 2, a hosel 3 and a back face 4.

Figure 3:
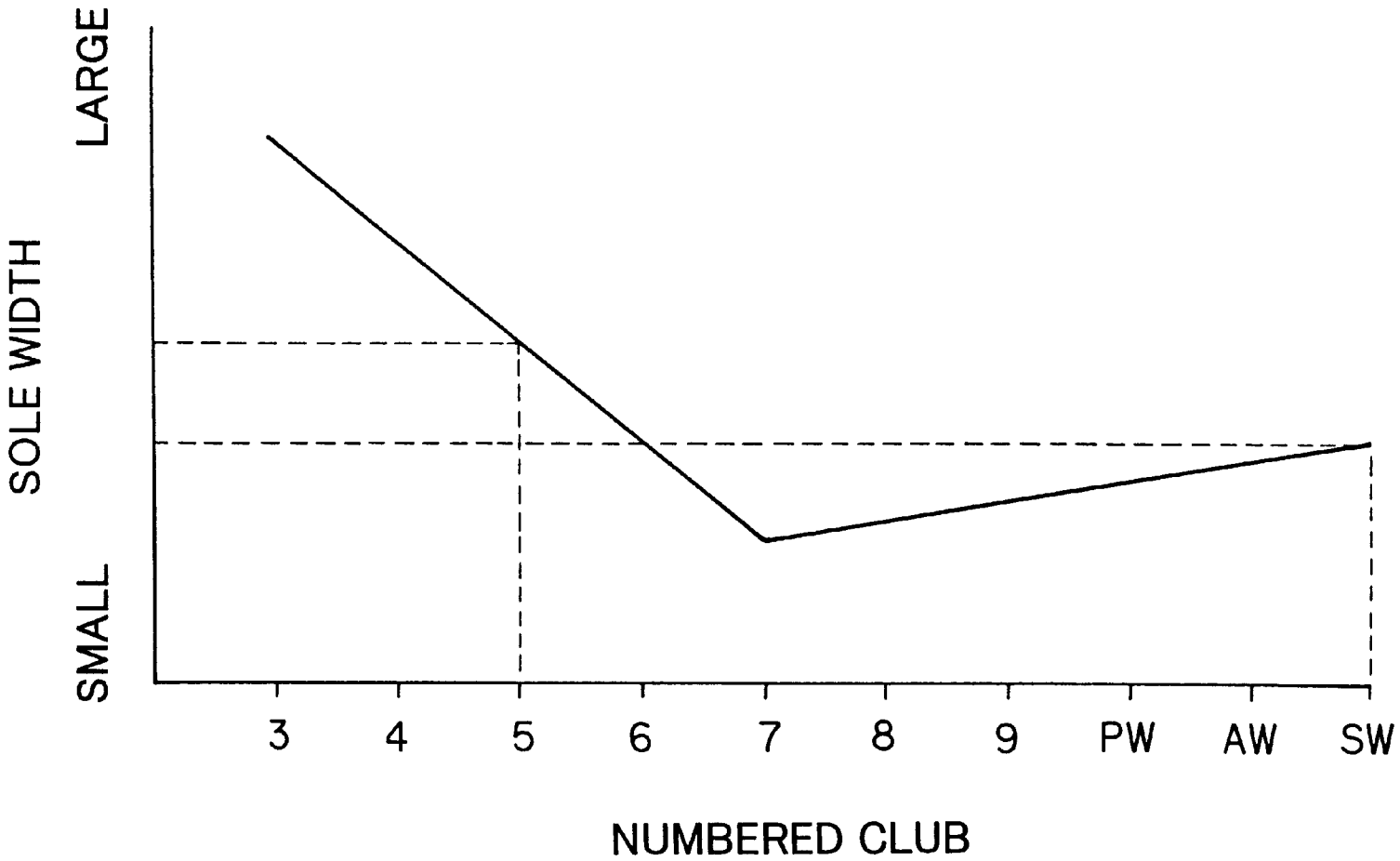
FIG. 3 is a graph illustrating a relationship between numbered clubs of the iron golf club set of the present invention with their sole widths.

The above-mentioned 10 clubs have sole widths W1, which are different from each other as shown in FIG. 3. FIG. 3 is a graph illustrating a relationship between the numbered clubs of the iron golf club set of the present invention with their sole widths W1. An abscissa of the graph represents a number of the club and an ordinate represents a value of sole width W1.

As is clear from FIG. 3, the sole widths W1 of the iron golf clubs become gradually larger from No. 7 iron club toward a lower lofted iron club having the smaller loft angle than that of the No. 7 iron club and a higher lofted iron club having the larger loft angle than that of the No. 7 iron club. In addition, the sole widths of No. 5 iron club and iron golf clubs having the smaller loft angle than that of No. 5 iron club are larger than the sole width of a sand wedge.

Below is a table showing the relationship between the numbered clubs of the iron golf club set of the present invention, their loft angles, i.e., angles L between a plane P passing through the central axis of the hosel 3 and the face 1 (see FIG. 2) and their sole widths W1.

TABLE 1

| Numbered club | 3 | 4 | 5 | 6 | 7 | 8 | 9 | PW | AW | SW |
|---|---|---|---|---|---|---|---|---|---|---|
| Loft angle (degrees) | 19 | 22 | 25 | 28 | 31 | 34 | 38 | 43 | 49 | 55 |
| Sole width (mm) | 34 | 31.5 | 29 | 26.5 | 24 | 25 | 26 | 26.5 | 26.5 | 27 |

As shown in Table 1, the sole widths of the iron golf clubs of from No. 3 iron club to No. 7 iron club gradually decrease from 34 mm to 24 mm in this order of the consecutively numbered clubs. On the contrary, the sole widths of the iron golf clubs of from No. 7 to the sand wedge gradually increase from 24 mm to 27 mm in this order of the consecutively numbered clubs.

In addition, the sole widths of No. 5 iron club and the iron golf clubs having the smaller loft angle than that of No. 5 iron club are within the range of from 29 mm to 34 mm, which is larger than the sole width of 27 mm of the sand wedge. The sole width of No. 6 iron club is substantially identical with that of the sand wedge.

According to the present invention described above, for example, No. 3 iron club serving as the lower lofted iron club has the sole width of 34 mm, which is larger than the sole width of 27 mm of the sand wedge. Accordingly, the center of gravity G1 of the head H is apart upward from the sole 2 by the short distance H1 and is apart rearward from the face 1 by the long distance, resulting in a larger value of depth of the center of gravity, i.e., the longer horizontal distance D1 from the leading edge 5 to the center of gravity G1. It is therefore possible to lower the center of gravity of the club head to make the sweet spot wider, leading to improvement in hitting properties, and make it easy to increase the trajectory of the resultant ball flight after being hit by the club.

So long as there are satisfied two conditions, i.e., (1) the sole widths of the iron golf clubs becoming gradually larger from No. 7 iron club toward the lower lofted iron club having the smaller loft angle than that of No. 7 iron club and toward the higher lofted iron club having the larger loft angle than that of No. 7 iron club and (2) the sole widths of No. 5 iron club and the iron golf clubs having the smaller loft angle than that of No. 5 iron club being larger than the sole of the sand wedge, the increase ratio in sole width may be determined arbitrarily. The increase ratio mentioned above may be expressed by at least one curved line, other than by the straight lines as shown in FIG. 3.

Figure 4:
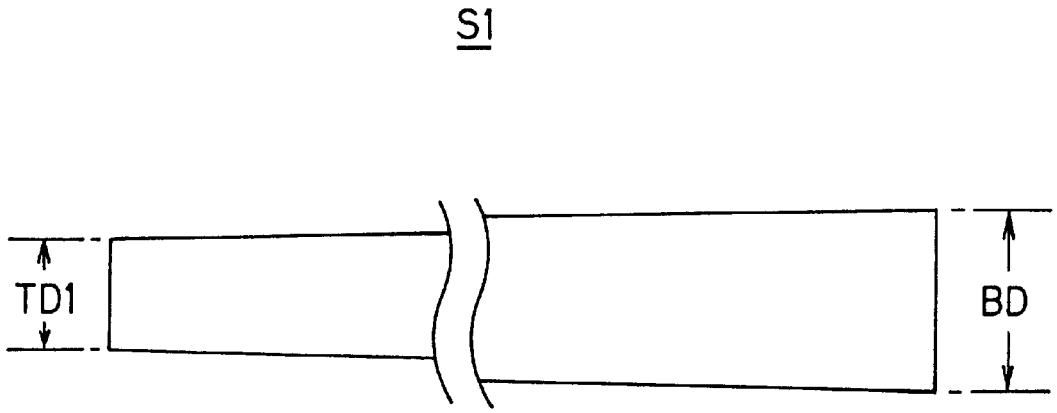
FIG. 4 is a schematic partial front view illustrating a tip diameter of shafts used for four clubs of from No. 3 to No. 6 iron clubs of the iron golf club set of the present invention.
Figure 5:
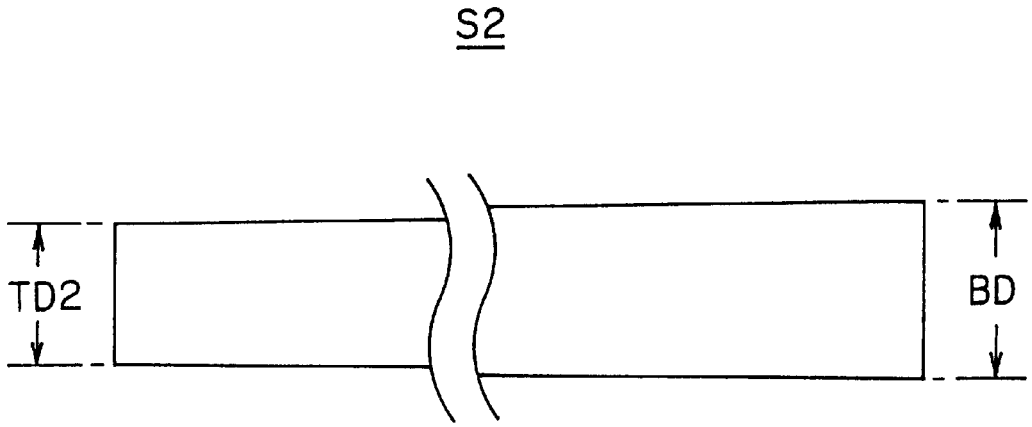
FIG. 5 is a schematic partial front view illustrating a tip diameter of shafts used for six iron clubs of from No. 7 iron club to a sand wedge of the iron golf club set of the present invention.

In the present invention, it is preferable to make the tip diameter TD2 of the shafts S2 for No. 7 iron club and the iron golf club having the larger loft angle than that of No. 7 iron club larger than the tip diameter TD1 of the shafts S1 for No. 6 iron club and the iron golf club having the smaller loft angle than that of No. 6 iron club (see FIGS. 4 and 5).

More specifically, it is preferable to use the shafts S1 as shown in FIG. 4 for the four clubs of from No. 3 to No. 6 iron clubs of the ten iron golf clubs, and to use the shafts S2 as shown in FIG. 5 for the six clubs of from No. 7 iron club to the sand wedge. The shafts S1 and the shafts S2 are identical with each other in the diameter of their rear end, i.e., the butt diameter BD, but are different from each other in the diameter of their front end, i.e., the tip diameter TD1, TD2.

It is preferable to limit the tip diameters TD1 of the shafts S1 within the range of from 8.5 mm to 9.0 mm. In this case, the tip diameters TD1 may be kept uniformly as a prescribed value within the range mentioned above or may gradually increase within that range according as the number of iron golf club increases.

It is preferable to limit the tip diameter TD2 of the shafts S2 to 9.4 mm.

In the preferred embodiment described above of the present invention, the tip diameter TD2 of the shafts S2 is larger than the tip diameter TD1 of the shafts S1 by a value within the range of from 0.4 mm to 0.9 mm.

It is also preferable to limit the butt diameter BD of each of the shafts S1 and S2 to 15 mm.

According to the above-described construction, the middle lofted iron clubs and the higher lofted iron clubs, which include the shafts S2, i.e., the iron golf clubs of from No. 7 iron club to the sand wedge provide a golf player with a hitting accuracy so as to prevent a ball flight in an unintended right or left-hand direction, and have a relatively high loft angle, thus making it possible to increase the trajectory of the resultant ball flight after being hit by the club. On the contrary, the lower lofted iron clubs and the middle lofted iron clubs, which include the shafts S1, i.e., the iron golf clubs of from No. 3 iron club to No. 6 iron club have the smaller tip diameter TD1 so as to permit to hit the golf ball in a sweeping motion, irrespective of relatively lower loft angle, thus making it possible to increase the trajectory of the resultant ball flight after being hit by the club.

In addition, in the present invention, it is preferable to lower the center of gravity of the club head and to further widen the sweet spot by providing ribs la formed on the back surface of the face 1 so as to project rearward, and by causing the projection lengths to vary in the vertical direction and/or the horizontal direction of the face 1.

Figure 6:
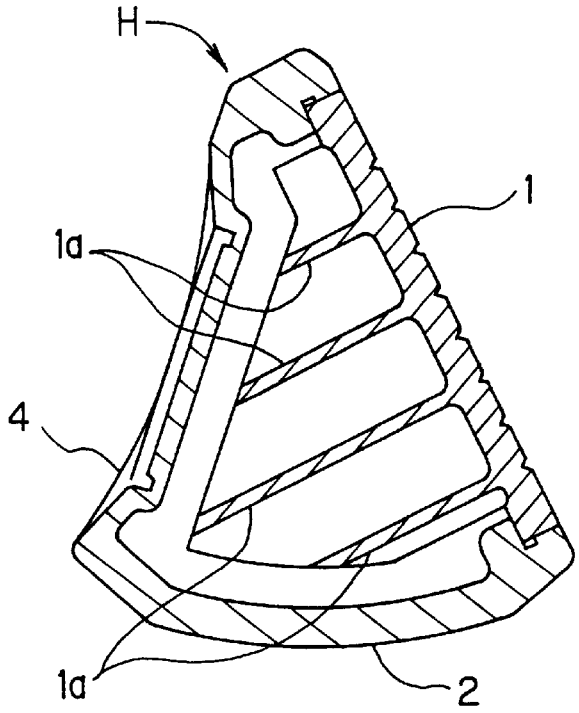
FIG. 6 is a cross-sectional view cut along the VI—VI line in FIG. 1.

More specifically, the face 1 has the back face on which the ribs la are formed so as to project rearward. The entirety of the ribs la forms a honeycomb structure 6 (see FIG. 7) in the shape of sector in the vertical section of the club head as shown in FIG. 6. The honeycomb structure 6 imparts a prescribed strength to the face 1 and performs the lightening of the club head. As is clear from FIG. 6, the projection lengths of the ribs la gradually increase from the upper end of the face 1 to its portion descending therefrom by the distance of about three fourths of the vertical length of the face 1 and gradually decrease from the above-mentioned portion to the lower end of the face 1. The shape of the ribs 1*a* varies so as to correspond to the shape of the back face 4 of the head H. The structure of the ribs 1*a* described above makes it possible to lower the center of gravity of the club head.

The projection lengths of the ribs 1*a* described above of the face 1 may vary not only in the vertical direction of the face 1, but also in the horizontal direction thereof.

Figure 8:
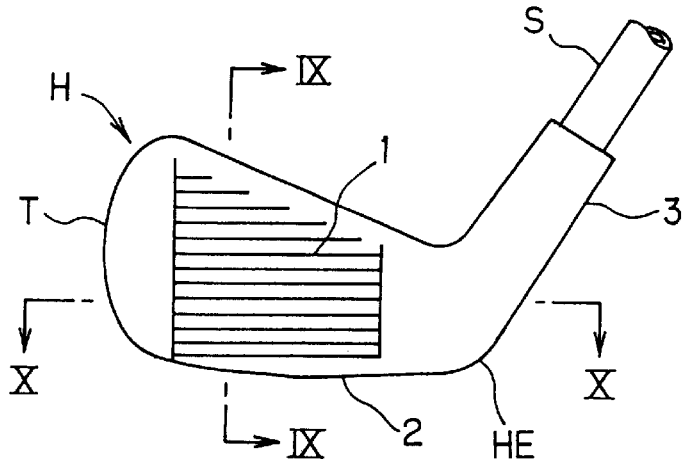
FIG. 8 is a partial front view illustrating a modification of the iron golf club as shown in FIG. 1.
Figure 9:
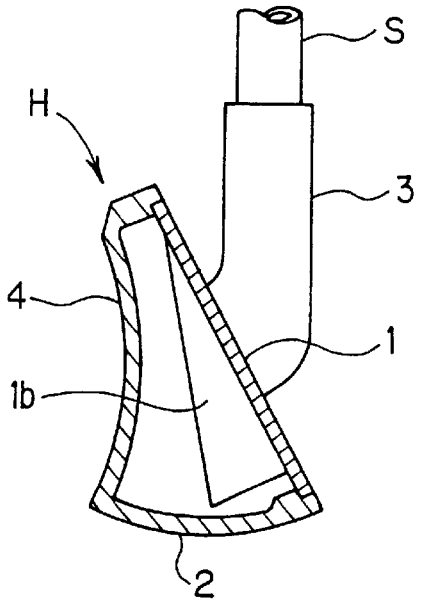
FIG. 9 is a cross-sectional view cut along the IX—IX line in FIG. 8.
Figure 10:
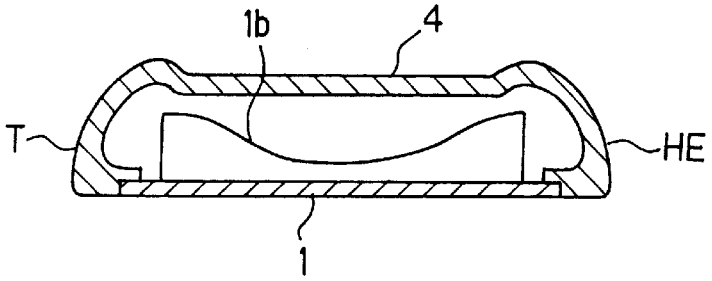
FIG. 10 is a cross-sectional view cut along the X—X line in FIG. 8.

FIGS. 8 to 10 illustrate a golf club provided with the face 1 having the ribs 1*b*, which are different from the above-described ribs la. The ribs 1*b* project rearward from the back surface of the face 1 in the same manner as in the above-described ribs 1*a*, but the projection lengths of the ribs 1*b* gradually increase from the upper end of the face 1 to the lower end thereof. As a result, the ribs 1*b* reveal a triangular shape in the vertical cross-section of the club head, as shown in FIG. 9, which is a cross-sectional view cut along the IX—IX line of FIG. 8. The ribs 1*b* having su a shape make it possible to lower further the center of gravity of the club head.

The projection lengths of the ribs 1*b* gradually increase from the central portion of the face 1 toward its right and left-hand portions, i.e., the toe T and the heel HE so that the imaginary line connecting the end portions of the ribs 1*b* in the horizontal direction forms the curved line. As a result, the ribs 1*b* project so that the thickness of each of the toe T side portion and the heel HE side portion of the combined body of the face 1 with the ribs 1*b* is larger than that of the central portion thereof in the horizontal cross-section of the club head, as shown in FIG. 10, which is a cross-sectional view cut along the X—X line of FIG. 8. The structure of the ribs 1*b* described above makes it possible to manufacture the club head having a large moment of inertia. In FIG. 10, the ribs 1*b* have the same variation ratio of their projection lengths in the left-hand region between the center of the sweet spot and the toe T and the right-hand region between the center of the sweet spot and the heel HE. The present invention is not limited to such an embodiment. For example, there may be adopted a structure that the ribs 1*b* locating in the toe T side have the longer projection lengths than the ribs 1*b* locating in the heel HE side so as to shift the center of gravity of the club head to the toe T side, thus making it possible to fade easily a golf ball. On the contrary, there may be adopted a structure that the ribs 1*b* locating in the heel HE side have the longer projection lengths than the ribs 1*b* locating in the toe T side so as to shift the center of gravity of the club head to the heel HE side, thus making it possible to draw easily the golf ball.

Figure 11:
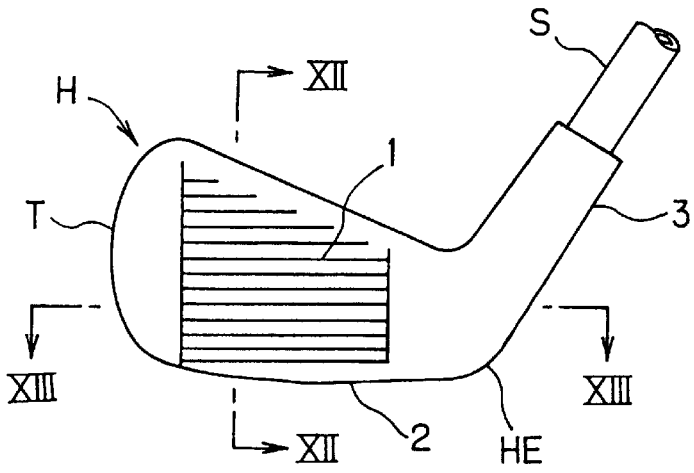
FIG. 11 is a partial front view illustrating another modification of the iron golf club as shown in FIG. 1.
Figure 12:
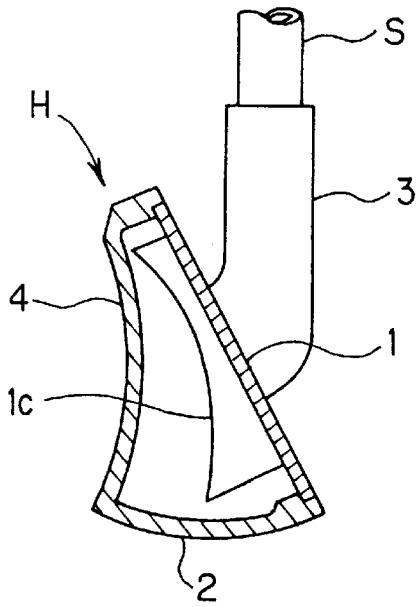
FIG. 12 is a cross-sectional view cut along the line XII—XII in FIG. 11.
Figure 13:
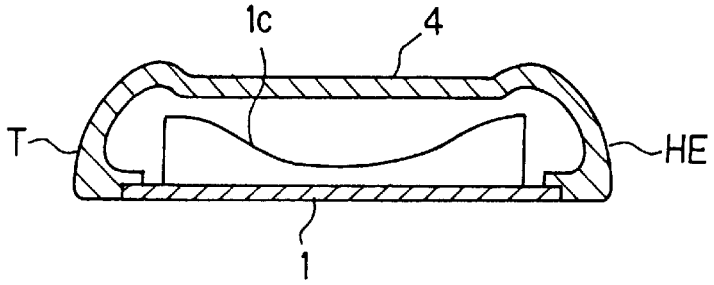
FIG. 13 is a cross-sectional view cut along the line XIII—XIII in FIG. 11.
Figure 14:
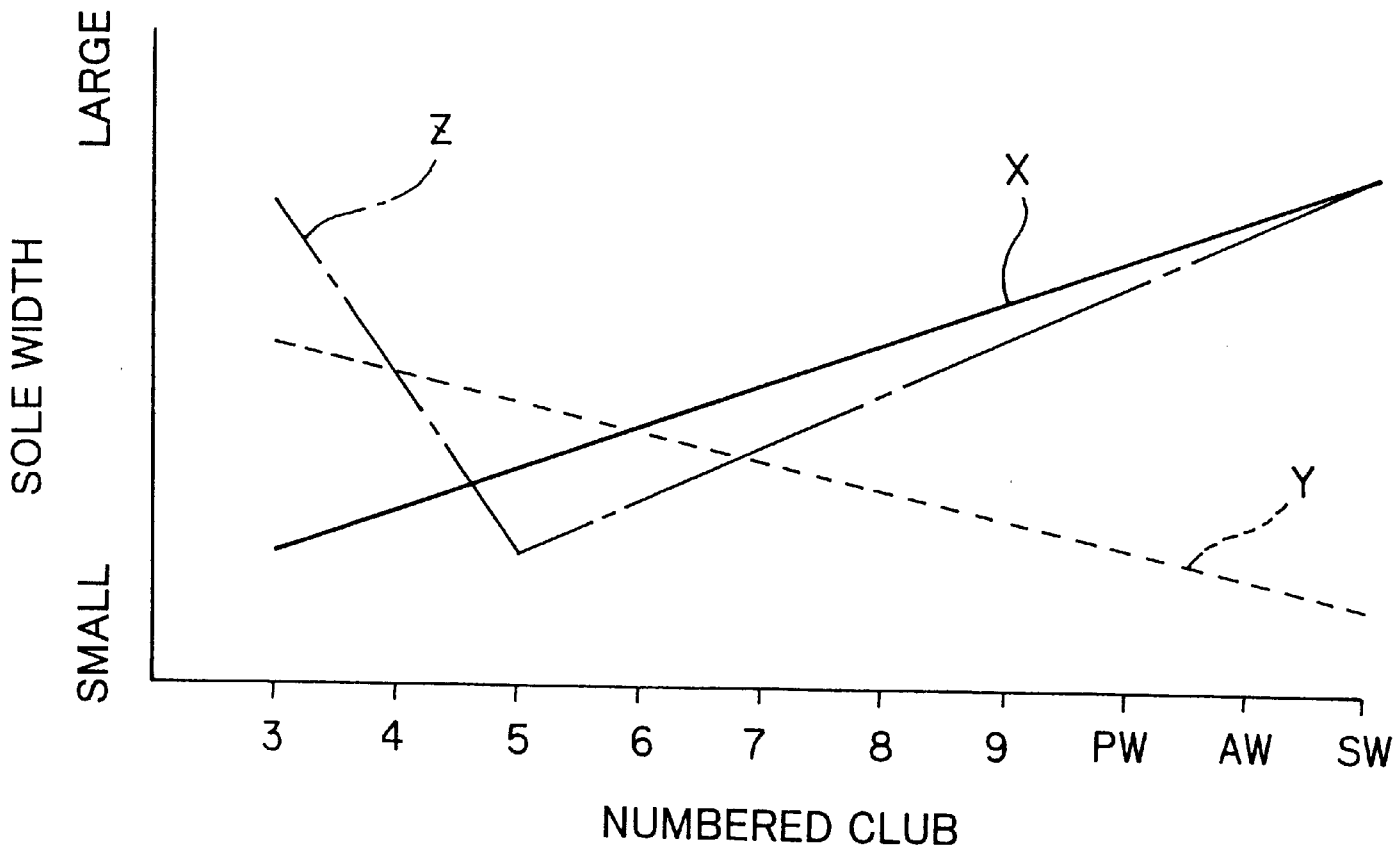
FIG. 14 PRIOR ART
FIG. 14 is a graph illustrating a relationship between numbered clubs of the iron golf club sets of the prior arts 1 to 3 with their sole widths.
Figure 15:
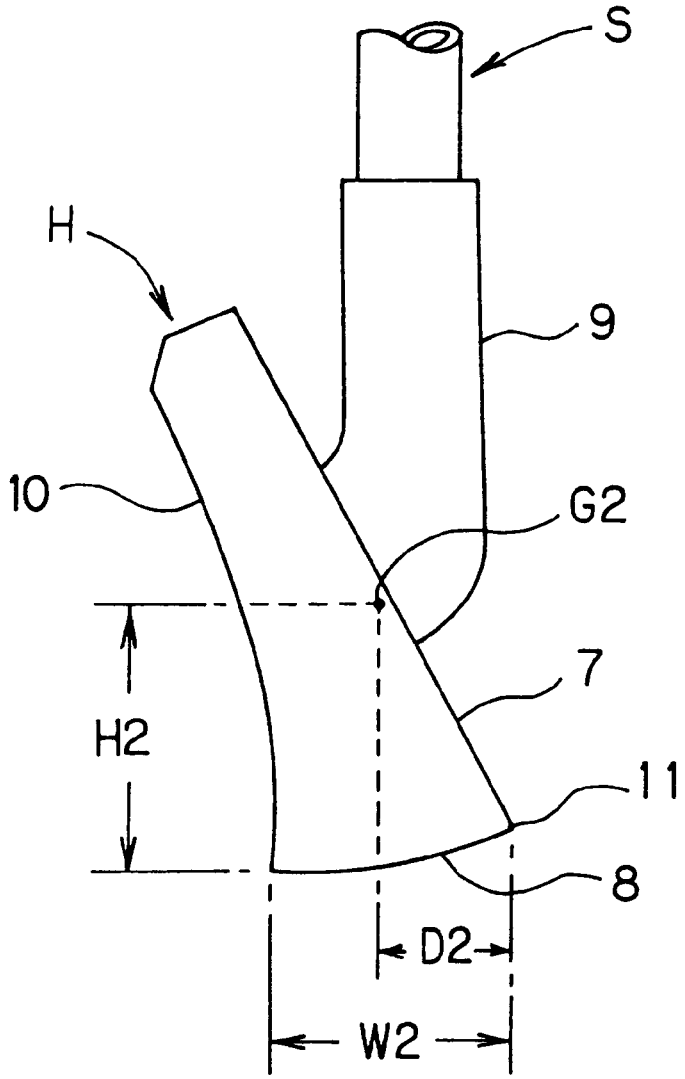
FIG. 15 PRIOR ART
FIG. 15 is a side view of the iron golf club of the prior art 1.

FIGS. 11 to 13 illustrate a golf club provided with the face 1 having the ribs 1*c*, which are different from the above-described ribs 1*a*. The ribs 1*c* project rearward from the back surface of the face 1 in the same manner as in the above-described ribs 1*a*, but the projection lengths of the ribs 1*c* gradually increase from a portion ascending from the center of the face 1 by a short distance toward the upper and lower ends of the face 1 so that the imaginary line connecting the end portions of the ribs 1*c* in the vertical direction forms the curved line. As a result, the ribs 1*c* project so that the thickness of each of the upper and lower end portions of the combined body of the face 1 with the ribs 1*c* is larger than that of the central portion thereof in the vertical cross-section of the club head, as shown in FIG. 12, which is a cross-sectional view cut along the XII—XII line of FIG. 11. The structure of the ribs 1*c* described above makes it possible to lower the center of gravity of the club head.

The projection lengths of the ribs 1*c* gradually increase from the central portion of the face 1 toward its right and left-hand portions, i.e., the toe T and the heel HE so that the imaginary line connecting the end portions of the ribs 1*c* in the horizontal direction forms the curved line. As a result, the ribs 1*c* project so that the thickness of each of the toe T side portion and the heel HE side portion of the combined body of the face 1 with the ribs 1*c* is larger than that of the central portion thereof in the horizontal cross-section of the club head, as shown in FIG. 13, which is a cross-sectional view cut along the XIII—XIII line of FIG. 11. The structure of the ribs 1*c* described above makes it possible to manufacture the club head having a large moment of inertia and a wide sweet spot.

Figure 7:
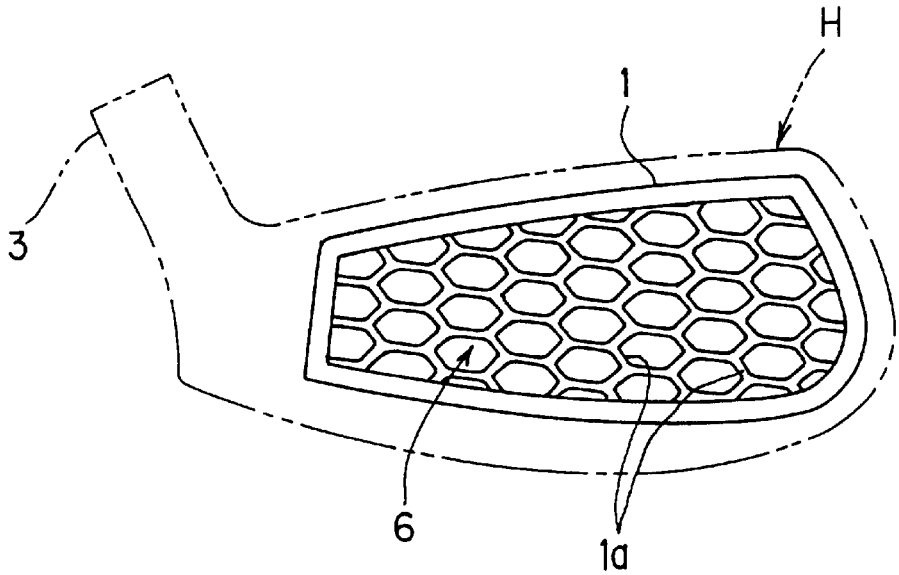
FIG. 7 is a rear view of the face as shown in FIG. 6.

In the above description, the ribs 1*a*, 1*b* and 1*c* form the honeycomb structure 6 as shown in FIG. 7. The reinforcement body formed by these ribs may have any structure, for example, a lattice-shape reinforcement structure, so long as the structure can impart a prescribed strength to the face 1. These ribs 1*a*, 1*b* and 1*c* may be formed integrally with the face 1, or separately therefrom.

The iron golf club set of the present invention is described to be used for a right-handed golf player. The present invention may be applied to the iron golf club set, which is used for a left-handed golf player.

According to the present invention described above, since, in an iron golf club set comprising a plurality of iron golf clubs having respective club numbers different from each other, sole widths of said iron golf clubs become gradually larger from No. 7 iron club toward a lower lofted iron club having a smaller loft angle than that of said No. 7 iron club and toward a higher lofted iron club having a larger loft angle than that of said No. 7 iron club; and the sole widths of No. 5 iron club and iron golf clubs having a smaller loft angle than that of said No. 5 iron club are larger than a sole width of a sand wedge, it is possible to lower the center of gravity of a club head to ensure a wide sweet spot, thus improving in hitting properties, and to easily increase the trajectory of the resultant ball flight after being hit with the use of any one of numbered clubs, especially a lower lofted iron club.

When shafts for the No. 7 iron club and iron golf clubs having a larger loft angle than that of the No. 7 iron club have a larger tip diameter than that of shafts for No. 6 iron club and iron golf clubs having a smaller loft angle than that of the No. 6 iron club, it is possible to easily hit the golf ball in a sweeping motion and to increase the trajectory of the resultant ball flight after being hit by the club.

When a face of each of the iron golf clubs has on its back surface ribs projecting rearward and the ribs have projection lengths, which vary in the vertical direction and/or the horizontal direction of the face, it is possible to lower the center of gravity of the club head and to widen further the sweet spot.

When the above-mentioned ribs have a honeycomb structure, it is possible to impart a prescribed strength to the face and to lighten the club head.

What is claimed is:

1. An iron golf club set, which comprises:

a plurality of iron golf clubs having respective club numbers different from each other, wherein:

sole widths of said iron golf clubs become gradually larger from No. 7 iron club toward a lower lofted iron club having a smaller loft angle than that of said No. 7 iron club and toward a higher lofted iron club having a larger loft angle than that of said No. 7 iron club; and the sole widths of No. 5 iron club and iron golf clubs having a smaller loft angle than that of said No. 5 iron club are larger than a sole width of a sand wedge.

2. The iron golf club set as claimed in claim 1, wherein:

shafts for said No. 7 iron club and iron golf clubs having a larger loft angle than that of said No. 7 iron club have a larger tip diameter than that of shafts for No. 6 iron club and iron golf clubs having a smaller loft angle than that of said No. 6 iron club.

3. The iron golf club set as claimed in claim 2, wherein:

a face of each of said iron golf clubs has on its back surface ribs projecting rearward; and said ribs have projection lengths, which vary in a vertical direction and/or a horizontal direction of said face.

4. The iron golf club set as claimed in claim 3, wherein:

said ribs form a honeycomb structure.

5. The iron golf club set as claimed in claim 1, wherein:

a face of each of said iron golf clubs has on its back surface ribs projecting rearward; and said ribs have projection lengths, which vary in a vertical direction and/or a horizontal direction of said face.

6. The iron golf club set as claimed in claim 5, wherein:

said ribs form a honeycomb structure.

* * * * *